United States Patent [19]

Kiefer

[11] Patent Number: 4,892,439

[45] Date of Patent: Jan. 9, 1990

[54] SCREED RAIL SYSTEM

[75] Inventor: Edward D. Kiefer, Fort Collins, Colo.

[73] Assignee: Gerald M. Kiefer, Fort Collins, Colo. ; a part interest

[21] Appl. No.: 321,634

[22] Filed: Mar. 9, 1989

[51] Int. Cl.[4] ..... E01C 19/22

[52] U.S. Cl. ..... 404/119; 404/118

[58] Field of Search ..... 404/118, 119, 75, 73; 425/458; 249/2, 3

[56] References Cited

U.S. PATENT DOCUMENTS 3,199,422 8/1965 Rees, Jr. ..... 404/73
4,115,976 9/1978 Rohrer ..... 404/119

FOREIGN PATENT DOCUMENTS 3125987 1/1983 Fed. Rep. of Germany ..... 404/119
982822 2/1965 United Kingdom ..... 404/119

*Primary Examiner*—Stephen J. Novosad
*Assistant Examiner*—Gay Spahn
*Attorney, Agent, or Firm*—Dean P. Edmundson

[57] ABSTRACT

A system for leveling concrete to provide a flat, planar upper surface. The system involves the use of elongated screed rails including upper and lower edges. The lower edge of each screen rail includes an elongated slot in each end portion. Each screed rail can be positioned over upright grade pins which extend into the slots and rest against the underside of the top edge of the screed rail. A leveling or strikeoff rod having a straight lower edge is supported on the upper edges of the screed rails. When the leveling rod is drawn along the screed rails it levels the poured concrete and provides a planar concrete surface.

11 Claims, 2 Drawing Sheets

SCREED RAIL SYSTEM

FIELD OF THE INVENTION

This invention relates to techniques and apparatus for leveling concrete (e.g., in the pouring of concrete floors, parking lots, etc.). More particularly, this invention relates to screed rails used for leveling concrete.

BACKGROUND OF THE INVENTION

Concrete is a very commonly used construction material for floors in buildings, for parking lots, driveways and the like. Typically the concrete is poured onto the ground or other support surface and then is leveled to the desired grade level or shape so that it will cure in place.

Conventionally, a mud screed method or a pipe screed method is used to shape concrete to the desired level or shape. Using the mud screed method, metal stakes (called grade pins) are driven into the ground in a manner such that the top of each pin will be level with the top of the slab that is being poured or cast. The grade pins are typically spaced about ten feet apart throughout the entire area in which the concrete is to be poured. Then, after an amount of concrete has been delivered to the site and poured onto the ground around the grade pins, the concrete is leveled manually with a strikeoff rod (sometimes referred to herein as a leveling board or rod) between the grade pins to form a mud screed. "Mud" is a conventional slang term for concrete.

The mud screed is used as a guide or leveling screed guide to strikeoff the mud or concrete to the desired level or shape.

When an experienced workman uses the mud screed method, he is relying upon his eyes, hands and arms to keep the strikeoff rod from going above or below the proper mud screed level. Unfortunately, the end result is never very accurate because even an experienced workman is not able to consistently maintain the mud screed level at all points between the grade pins. Also, a significant amount of time is required to form and work with the mud screed in this manner. It is a tedious job.

Consequently, it is common for a finished concrete surface to have high areas and low areas (i.e., areas where the concrete surface is more than ¼ inch off, high or low, from where it is supposed to be). Thus, the concrete surface is wavy. This is very undesirable. Often a poured concrete floor does not meet the required specification and has to be patch-leveled or ground down afterwards, and these procedures are very time consuming and costly.

One alternative to the use of the mud screed method of pouring, casting, or placing concrete is the pipe screed method. It involves the placement of a number of special stakes in the ground in a straight line. The top of each stake includes a holder for supporting a pipe in a horizontal plane. Several such stakes support a single pipe.

Then a leveling board or strikeoff rod is supported on two of such pipes and drawn along the pipes to level or strikeoff the concrete. However, this technique requires the use of special stakes with either nails or rocker chairs on top of the stakes so that the pipe does not roll off of the stakes. Also, the pipes must be supported along their length by three or more stakes. This requires that the stakes be in perfect alignment. This system is also very time consuming to set up and consequently is more costly. Therefore, the pipe screed method is used on only a small number of jobs compared to the mud screed method of casting concrete.

There has not heretofore been provided a screed rail and a leveling system of the type provided by the present invention.

SUMMARY OF THE INVENTION

In accordance with the present invention there is provided a unique screed rail and a simple and efficient system for leveling concrete at a job site. The present invention exhibits the advantages of both the mud screed method and the pipe screed method but does not include the disadvantages of those two prior methods.

The screed rail of the invention comprises an elongated, preferably tubular, rectangular rail having an opening or slot in the lower edge near each end thereof. The screed rail is rigid and stiff so that it can support a leveling board or rod without sagging. It is preferably hollow so that it is easy to carry and handle, yet it is sufficiently heavy to remain resting on the tops of two adjacent grade pins when concrete is poured.

The leveling system of the invention involves use of two of the novel screed rails. Each screed rail is adapted to be supported on the tops of two adjacent grade pins. Then a conventional leveling board or strikeoff rod is used to strikeoff the concrete to the grade or plane desired. In order to level the concrete the leveling board or strikeoff rod is simply pulled or drawn along the screed rails. Any concrete which projects above the level of the top of the screed rails is accordingly pushed ahead of the strikeoff rod and displaced until all the concrete is at the screed rail level or plane.

This strikeoff operation is performed quickly and efficiently to provide a desired flat, planar surface, without the need for highly skilled labor. Also, since only two grade pins are required for supporting each screed rail, exact placement or alignment of the grade pins is not required. The same grade pins as used in the mud screed method can be used effectively and efficiently in the present invention. This is a very distinct advantage because no other screed rail support system is required for this invention, many hours of labor are saved. Also, the screed rail of this invention will not roll off of the grade support pins because the depending flanges or sides of the rectangular tubular member fit closely to the sides of the grade pins. Using the screed rail system of this invention, a concrete slab can be cast or poured in approximately one-half the time required when using the conventional mud screed method. Another advantage of using the screed rail system of this invention is that it allows the use of the more preferred low slump concrete which has superior qualities.

BRIEF DESCRIPTION OF THE DRAWINGS

The invention is described in more detail hereinafter with reference to the accompanying drawings, wherein like reference characters refer to the same parts throughout the several view and in which.

DETAILED DESCRIPTION OF THE INVENTION

Figure 1:
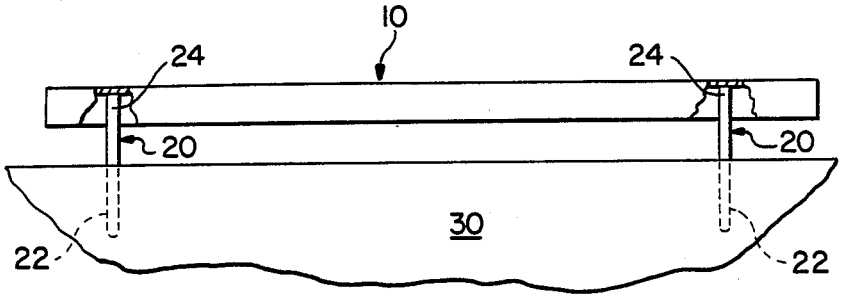
FIG. 1 is a side elevational view illustrating the manner in which a screed rail of this invention is supported at a job site for use in leveling or striking off concrete.

The invention is illustrated by means of the accompanying drawings. FIG. 1 is a side elevational view, partially cut-away, of a screed rail 10 of the invention which is shown supported on the top of grade pins 20. The lower ends 22 of the grade pins are driven into the ground 30 in a manner such that the pins are upright and are driven to solid footing so that they cannot move downwardly when pressure is applied to the top of such pins. The upper ends 24 of the pins are set at the top of the finished concrete slab grade. In other words, the upper ends of the pins define a plane or grade for the concrete slab to be poured.

Figure 3:
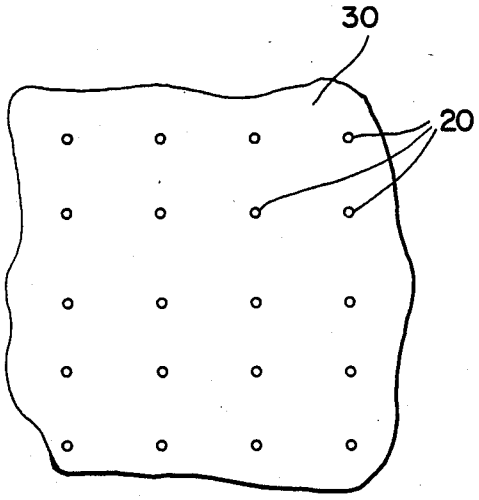
FIG. 3 is a top view of a portion of a typical job site showing a plurality of grade pins driven into the ground.

The grade pins 20 are typically spaced about 10 feet apart from each other in the ground, although normally this distance not determined exactly. FIG. 3 is a top view of a job site where the tops of a plurality of grade pins 20 are shown. As illustrated herein, the placement of the grade pins is not exact, i.e., they are not equally spaced from each other nor are they necessarily aligned in perfect rows.

The screed rail of the invention may be provided in any desired length, although lengths in the range of about 4 to 12 feet are most convenient, depending upon the spacing between grade pins at the job site. The most common length for the screed rail will be 12 feet. The screed rail preferably comprises a hollow tubular steel member having a rectanguaar cross-section. The width of the rail is preferably in the range of about $\frac{7}{8}$ to $1\frac{1}{8}$ inches (preferably 1 inch), and the depth of the rail is preferably about $1\frac{1}{2}$ to 2 inches (most preferably 2 inches).

Typically the grade pins have a diameter of about 0.5 inch. Thus, the openings in lower edge of the tubular member must be slightly wider than 0.5 inch so that the screed rail can be easily and readily placed over the grade pins when desired. Thus, when the grade pins are 0.5 inch in diameter, it is preferred that the slotted openings in the screed rail be about $\frac{5}{8}$ inch wide or $\frac{1}{8}$ inch wider than the diameter of the grade pins used. Thus, if the grade pins are $\frac{3}{8}$ inch in diameter then the slotted openings in the screed rail should be about $\frac{1}{2}$ inch wide.

Figure 2:
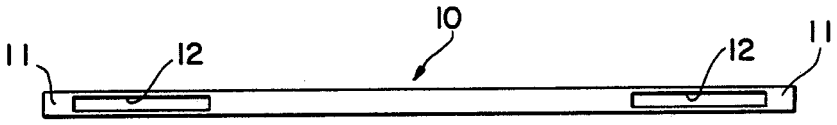
FIG. 2 is a bottom view of the screed rail shown in FIG. 1.

The two slotted openings 12 in the lower edge of the tubular member are illustrated in FIG. 2. The slotted openings may vary in length. Preferably they are each about 12 to 24 inches (preferably 18 inches) in length. This allows the screed rail to be supported on grade pins having a variance in spacing. If desired, the slotted opening on the bottom edge of the screed rail could extend over the full length of the screed rail provided that the screed rail is composed of a rigid and strong material which is capable of maintaining its original shape during use. In other words, it is necessary for the slotted opening(s) to maintain its shape during use. The slotted opening(s) should have a width which is no more than $\frac{1}{8}$ inch larger than the diameter of the grade pins used, and the width should not change during use of the screed rail.

In the embodiment of screed rail illustrated in FIG. 2, the slotted openings 12 do not extend all the way to the end of the tubular member. For example, there is preferably a portion 11 at each end which is not removed, and preferably the central potion between the slots 12 is not removed. The portions of the lower edge which are not removed help to maintain the rigidity, shape and flexural strength of the tubular member. These portions also prevent the lower edge of the tubular member from spreading outwardly and creating too much play between the grade pin and the edges of the slotted opening. Preferably this amount of play should not exceed $\frac{1}{8}$ inch at any time.

Preferably the screed rail is made of steel which is rigid and will not sag during normal use. The wall thickness of the metal should be about 0.083 inch (14 gauge) to 0.120 inch (11 gauge). Preferably the wall thickness of metal is 0.083 inch. Other types of metal could also be used, if desired, such as magnesium or aluminum provided it is sufficiently rigid to maintain its shape during use. Composite materials could also be used if sufficiently rigid.

Figure 4:
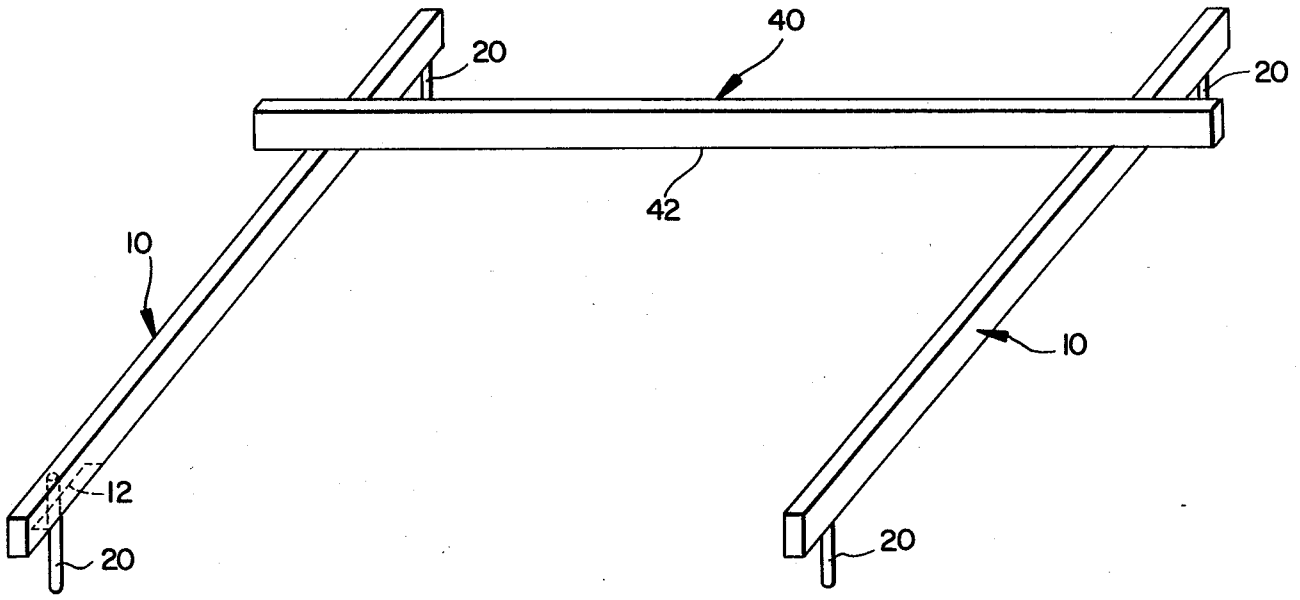
FIG. 4 is a perspective view illustrating two screed rails supported in a spaced-apart manner on the tops of grade pins for leveling concrete using a leveling board or strikeoff rod.

FIG. 4 is a perspective view illustrating the use of two screed rails 10 in supporting a conventional leveling board or strikeoff rod 40 for leveling concrete. Each screed rail is supported on only two spaced apart grade pins 20. Each grade pin is driven into the ground, and the upper end passes through a slotted opening 12 in one end of a screed rail and rests on the underside of the top edge of the tube (in the manner illustrated in FIG. 1). After concrete is poured onto the ground between the screed rails it can be quickly and accurately leveled to provide a planar upper surface by means of the leveling rod or strikeoff rod 40 being supported on and pulled along the upper edges of the two screed rails. The lower edge 42 of the leveling rod or strikeoff rod 40 is a straight edge so that a planar upper surface of the concrete results.

After the concrete has been leveled in one area, the screed rails can be simply moved to adjacent grade pins where additional concrete is poured and the process repeated. Because only two grade pins are used to support each screed rail, there is no need to carefully align the grade pins when they are placed in the ground. When the screed rails are lifted from the grade pins, a small amount of concrete is used to fill in the narrow grooves left by the screed rails. The filler concrete is placed as soon as the screed rail is moved to adjacent grade pins.

Then the slab that has been screeded or striked off can be finished in accordance with any desired conventional technique as specified by the architect or engineer in charge.

Other variants are possible without departing from the scope of the present invention. For example, plugs could be included in the ends of the tubular member, as well as adjacent the ends of each slotted opening, to prevent concrete from entering into the tubular member. However, concrete can be easily flushed out of the tubular member with water, if desired.

What is claimed is:

1. A screed rail system for leveling concrete to provide a planar top surface, said system comprising:

(a) a first pair of upright spaced-apart grade pins having upper ends supported in a manner such that said upper ends define a grade above a support surface which is to be covered with concrete;

(b) a second pair of upright spaced-apart grade pins having upper ends supported in a manner such that said upper ends define a grade above said support surface;

(c) first and second elongated screed rails each comprising an elongated tubular member having a rectangular cross-section and including upper and lower edges and first and second end portions; wherein said upper edge defines a straight edge along the length of said screed rail; and wherein said lower edge includes an elongated slotted opening in each of said end portions;

(d) an elongated leveling rod having a lower portion which defines a straight edge;

wherein said first screed rail is supported on said first pair of spaced-apart grade pins, said grade pins extending into said slotted openings in said lower edge of said first screed rail; wherein said second screed rail is supported on said second pair of spaced-apart grade pins, said grade pins extending into said slotted openings in said lower edge of said second screed rail; wherein said leveling rod is supported on said first and second screed rails in a manner such that said lower portion of said leveling rod defines a planar surface as said leveling rod is drawn along the length of said screed rails.

2. A system in accordance with claim 1, wherein each said screed rail has a length in the range of about 4 to 12 feet, a width in the range of about $\frac{7}{8}$ to $1\frac{1}{8}$ inches, and a height in the range of about $1\frac{1}{2}$ to 2 inches.

3. A system in accordance with claim 1, wherein said grade pins in said first and second pairs are spaced approximately 10 feet apart, and wherein said first pair is spaced approximately 10 feet from said second pin.

4. A system in accordance with claim 1, wherein said screed rails each comprise a tubular steel member having a wall thickness in the range of about 0.083 to 0.120 inch.

5. A system in accordance with claim 1, wherein each said slotted opening has a length in the range of about 12 to 24 inches and a width in the range of about 1/16 to $\frac{1}{8}$ inch larger than the diameter of said grade pins.

6. A screed rail comprising an elongated tubular member having a rectangular cross-section and including upper and lower edges and first and second end portions; wherein said upper edge defines a straight edge along the length of said tubular member; and wherein said lower edge includes an elongated slotted opening in each of said end portions.

7. A screed rail in accordance with claim 6, wherein said tubular member has a length in the range of about 4 to 12 feet, a width in the range of about $\frac{7}{8}$ to $1\frac{1}{8}$ inches, and a height in the range of about $1\frac{1}{2}$ to 2 inches.

8. A screed rail in accordance with claim 6, wherein said tubular member comprises steel having a wall thickness in the range of about 0.083 to 0.120 inch.

9. A screed rail in accordance with claim 6, wherein each said slotted opening has a length in the range of about 12 to 24 inches and a width of about $\frac{5}{8}$ inch.

10. A method for leveling concrete to provide a planar top surface, said method comprising the steps of:

(a) supporting a first pair of upright spaced-apart grade pins having upper ends in a manner such that said upper ends define a desired grade for said concrete;

(b) supporting a second pair of upright spaced-apart grade pins having upper ends supported in a manner such that said upper ends define a desired grade for said concrete;

(c) providing first and second screed rails each comprising an elongated tubular member having a rectangular cross-section and including upper and lower edges and first and second end portions; wherein said upper edge defines a straight edge along the length of said screed rail; and wherein said lower edge includes an elongated slotted opening in each of said end portions;

(d) supporting said first screed rail on said first pair of spaced-apart grade pins, said grade pins extending into said slotted openings in said lower edge of said first screed rail;

(e) supporting said second screed rail on said second pair of spaced-apart grade pins, said grade pins extending into said slotted openings in said lower edge of said second screed rail;

(f) providing an elongated leveling rod having a lower portion which defines a straight edge; and (g) supporting said leveling rod on said upper edges of said screed rails and drawing said leveling rod along the length of said screed rails.

11. A method in accordance with claim 10, wherein said grade pins in said first and second pairs are spaced approximately 10 feet apart, and wherein said first pair is spaced approximately 10 feet from said second pin.

* * * * *